US008984688B1

(12) United States Patent
Ibrahim

(10) Patent No.: US 8,984,688 B1
(45) Date of Patent: Mar. 24, 2015

(54) INFLATABLE RESTING PILLOW

(71) Applicant: Jimmy Arifino Ibrahim, Rose Bay (AU)

(72) Inventor: Jimmy Arifino Ibrahim, Rose Bay (AU)

(73) Assignee: Gateway Global Limited (VG)

( * ) Notice: Subject to any disclaimer, the term of this patent is extended or adjusted under 35 U.S.C. 154(b) by 0 days.

(21) Appl. No.: 13/654,323

(22) Filed: Oct. 17, 2012

(51) Int. Cl.
*A47C 20/00* (2006.01)
*A47G 9/10* (2006.01)

(52) U.S. Cl.
CPC ..... *A47G 9/10* (2013.01)
USPC ..... 5/632; 5/636; 5/638; 5/645; 5/646; 5/652; 5/652.1

(58) Field of Classification Search
CPC ..... A47C 20/026; A47C 20/02; A47C 7/021; A47C 7/022; A47C 16/00; A47C 7/383; A61G 7/07; A61G 13/121; A61G 13/12; A47G 9/10
USPC ..... 5/630, 632, 636, 637, 638, 639, 644, 5/645, 646, 652, 652.1, 655.5
See application file for complete search history.

(56) References Cited

U.S. PATENT DOCUMENTS

| | | | | |
|---|---|---|---|---|
| 3,315,282 | A * | 4/1967 | Lowery et al. | 5/638 |
| 3,883,906 | A * | 5/1975 | Sumpter | 5/632 |
| 6,175,979 | B1 * | 1/2001 | Jackson | 5/648 |
| 6,721,978 | B1 * | 4/2004 | Tankersley | 5/652 |
| 7,421,749 | B2 * | 9/2008 | Herschel | 5/632 |
| 7,555,794 | B2 * | 7/2009 | Zelnik et al. | 5/632 |
| 7,788,751 | B1 * | 9/2010 | Diemer et al. | 5/644 |
| 2003/0172462 | A1 * | 9/2003 | Hoggatt et al. | 5/657 |
| 2004/0064893 | A1 * | 4/2004 | Sharp | 5/655.3 |

* cited by examiner

*Primary Examiner* — William Kelleher
*Assistant Examiner* — Duoni Pan
(74) *Attorney, Agent, or Firm* — Robert E. Lyon

(57) ABSTRACT

An inflatable resting pillow comprises two inflatable compartments, the lower compartment providing a base to support the attached upper compartment; both compartments being separately inflatable. The upper compartment provides an opening facing the user for receiving the user's head with a number of inner support surfaces providing lateral, longitudinal and vertical stability. The upper compartment also includes lateral passageways allowing air circulation to the implanted face of the user, and other passageways for the user's arms by which to keep the device in stable contact with the user's body and to also provide means for the user to rest on the forearms to provide a stable and comfortable resting position with the person's head and upper body leaning forward upon the upper compartment; the combination of support structures designed to render stable support of the reposing user while achieving and maintaining optimum spinal alignment.

10 Claims, 2 Drawing Sheets

INFLATABLE RESTING PILLOW

BACKGROUND OF THE INVENTION

Field of the Invention

The present invention relates generally to a device for allowing or facilitating a person to rest comfortably in a basically upright sitting position. More specifically, the device that is placed on the lap of a user or directly in front of the user while in an upright or sitting position is intended to provide means for supporting the upper torso as well as the head and neck of the user and to reduce as possible stress on the spine.

It is well recognized that for the majority of passengers on common carriers, it is often difficult to relax in the seats provided. In most aircraft, the economy seats, even some of the more recent designs of reclining seats, typically provide closely spaced forward facing seats in rows separated by relatively small or inadequate space, known in the air transport trade as "pitch". Pitch configurations though designed to maximize economy of passenger miles for the carrier, do not maximize the comfort of the passengers. While the discussion of the present invention will be directed to aircraft seating, it is to be understood that similar problems and the solutions thereto likewise reside in other venues, including other common carriers including buses, trains and even multi-passenger motor vehicles. Reclining seats in most instances recline only a modest amount, insufficient to provide comfort on a long term basis. While some reclining seats provide a modicum of comfort, the instability of support provided by such seats allows a passenger's head and neck to be unstable both laterally and forwardly, especially during sleep or when dozing, which can impose more discomfort in the long term than the benefits of the semi-reclined position.

In recent years, a number of devices have become available intended to alleviate this discomfort. An early such device was the "neck pillow"—a donut-shaped inflatable cushion which surrounds the user's neck, passing under the chin. This can be worn when sitting upright, but best in a reclined position, and provides some support for the head and neck. More sophisticated designs are intended to provide enhanced stability for the head and neck and, in other advanced designs, more stability as well for the upper torso of the user. There have been a number of proposals which are found in the prior art, that provide enhanced degrees of stability for the slumbering passenger however, none of the prior art provides the degree of comfort and stability than does the design of the present invention, as will be completely set forth hereinafter. As restrictions increase upon the amount of hand baggage that a passenger may bring aboard an aircraft, it is important to enhance compactness when not in use so as to make a resting device easily transportable amidst the belongings of the passenger without being bulky or becoming an item of "checkable" or revenue-bearing baggage. A key factor then is to maximize the "inflatability" of the support device. Contrary to the design concepts of seats designed with limited backward reclination, the present invention addresses the use of a resting device in which the user positions himself in a forward leaning position. There exist in the prior art a number of designs which employ a comparable concept of the forward leaning resting device.

U.S. Pat. No. 5,645,319 (Parks) discloses an inflatable pillow that is attached to or rests upon a tray table or other surface directly in front of the user. When inflated, the device takes up the space between the tray table and the seatback in front of the user and provides for head support on a flat cushioned surface upon which the user's head may rest. No provisions are made for the arms or shoulders of the user or means to provide any other type of support for the upper torso of the user.

U.S. Pat. No. 6,042,185 (Cowgur) discloses an inflatable rectangular device that rests upon the lap of the user providing a flat surface to rest the head, arms and shoulders upon requiring the user to lean the upper body forward onto the pillow. The shortcomings of Cowgur are that the head and shoulders and optionally the arms of the user merely lean on the top surfaces of the rectangular pillow while providing neither lateral support nor restraint. Neither is any restraint provided for the arms and hands.

U.S. Application 2004/0064893 (Sharp) is similar to Cowgur in disclosing an inflatable pillow of substantially rectangular configuration that rests upon the lap of the user. The inflated outer shell provides an upper portion upon which the user's head may be placed as the person leans forward over the device. No lateral restraints are disclosed nor suggested. Arm retention pockets are provided along the sides, but they are merely for restraining the arms of the user and do not provide a means for using the arms to assist supporting the body of the user.

U.S. Pat. No. 6,973,691 (Cordova) discloses a head, neck and upper body support pillow disposed between the chin and lap of the user to limit both head and torso movements occurring during resting or sleeping while sitting in an upright position. While Cordova discloses some limited means for restraining lateral movement of the head and neck of the user by cradling the chin and face, restraint of the neck and head is limited. While straps or pockets are provided for restraint of the hands and arms, Cordova does not suggest the utilization of forearm surfaces for additional support of the upper torso.

U.S. Pat. No. 7,788,751 (Diemer) discloses an inflatable neck support where the user sits in an upright position with the head tilted forward, engaging the upper surfaces of the support device. While pockets or loops are provided for retaining the hands or arms of the user, the Diemer device discloses no means for providing upper torso support other than the support of the head and nominally the neck of the user. Neither does this patent disclose the use of the arms or forearms of the user to obtain stability or to provide additional upper torso support.

SUMMARY OF THE INVENTION

The known prior art do not appear to provide adequate measures or means of comfort and stability. It is the principle object of the present invention to provide in a resting pillow, vertical stability as well as lateral support for the user and in particular the user's head while resting or sleeping. It may be noted that in prior art devices, the head and/or neck are usually supported on a flat surface, where the head is turned on a side, facing either right or left, and the neck is bent significantly forward, curving the spine in the cervical region into an unnatural position. Likewise, most prior art devices like some mentioned above show the thoracic region of the spine curved in a unnatural forward configuration; and some devices result in a posture where even the lumbar spine is curved forwardly.

It is a particular advantage of the present invention that the head has "full-face" support much as is the posture achieved in the use of a sitting massage chair. Support of the full face (forehead, chin and both sides) achieves reduction of stress on more body parts than the prior art. It is an advantage of the present invention that the full-face "plant" provides both forward and lateral support for the head, which achieves a resting position which preserves to a great degree the ideal curvature of the spine; that is, the ideal "S" curvature of an upright posture, rather than a forward curled "C" shape which in leaning far forward causes the unnatural positions seen in the prior art devices. Resting in a position which preserves near-normal spine posture causes the least stress on the spine and hence more comfort for the entire body. The prior devices that allow the head to tilt too much downwardly can impart stress not only to the cervical spine, but can promote backward curvature of the lower spine which can stress the lumbar area as well.

Accordingly, it is a specific object of the invention to provide enhanced head, neck and spinal stabilization for the sleeping or resting passenger.

It is a further object of the invention to provide stabilization of the user's head and neck as well as support of the user's shoulders and upper torso.

It is a further object of the present invention to provide improved stabilization of the user's head, neck and upper torso as well as the stabilization of the user's arms.

It is also an object of the present invention to provide a resting device that stabilizes the head, neck, upper torso and arms of the user, while also providing limitations of exposure of the eyes of the user to ambient light, thereby enhancing the sleeping experience.

These and other objects and advantages of the present invention, are achieved in part by the user's body leaning only slightly forward, with the chest and forearms supporting the upper arms, shoulders and upper torso; while the head of the user is supported upright in the upper opening of the pillow in a full face plant disposition, thereby gaining lateral stabilization for all sides of the head. Support of the chin and forehead stabilizes the neck of the user, gaining substantially increased comfort and support. Positioning the entire upper body leaning slightly forward, but upright, and with the head tilted slightly backward, diminishes stress on the cervical spine (around the neck area), and reduces stress on the lower spine or lumbar area as well.

These and other objects, features and advantages of at least one embodiment of the present invention will be more distinctly set forth and described in the ensuing specification and drawings; and delineated in the accompanying claims.

DESCRIPTION OF A PREFERRED EMBODIMENT OF THE INVENTION

Figure 1:
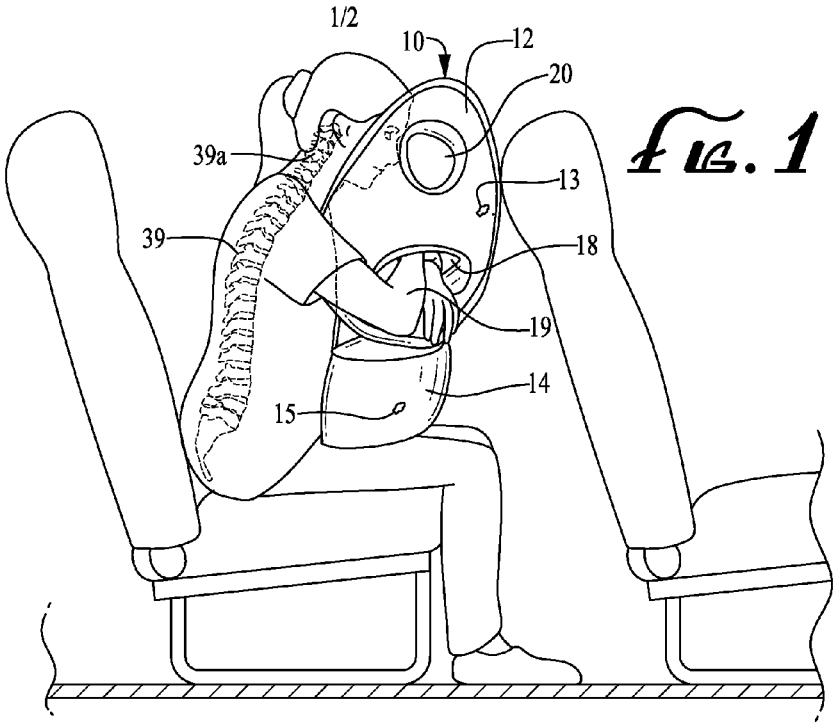
FIG. 1 is a side elevation view of a person sitting in a seated position, utilizing the resting pillow of the present invention, wherein the full face plant insertion is illustrated, with the spine shown in dotted line.

In all the drawing Figures, where like numerals refer to the same item, the pillow generally designated 10 consists primarily of two compartments, an upper compartment 12 and a lower compartment 14. The two compartments are fastened together by any suitable means and each is air inflatable by means of air valves 13 and 15 respectively. These air valves are of a conventional design which can allow the user to inflate each compartment and close off the valve in well-known fashion. The upper and lower compartments are separately inflatable so that a different degree of firmness may be obtained for each. For example, greater air pressure may be desired in lower compartment 14 so as to provide a more stable support base for the entire device, while the pressure in the upper compartment 12 can be selected to be softer or more firm according to the desired comfort of the user. The construction of the pillow employs a flexible, air-retentive material and the outer surfaces of compartments 12 and 14 are preferably covered by a fabric covering (not specifically shown) so as to absorb body moisture.

Figure 5:
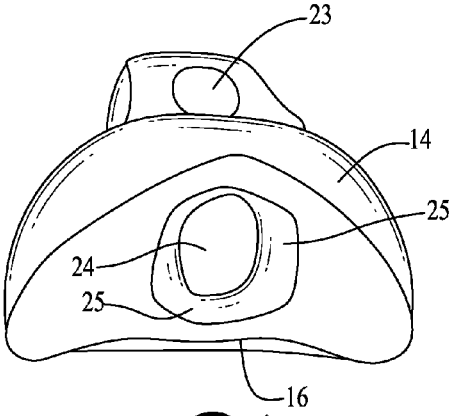
FIG. 5 is a view of the bottom of the pillow.

In FIG. 5 it will be seen that the lower compartment or support base 14 has an arcuate surface 16. This is the portion of the base which is intended to confront the user and the arcuate shape accommodates the shape of the lower torso. Upper compartment 12 likewise has a generally arcuate shape which confronts the upper torso and receives the head of the user. The sidewalls of upper compartment 12 are provided with a number of pass-through holes or passageways.

The lateral passageways 18 in the lower half of upper compartment 12 are provided to accommodate the arms of the user. By extending forearms 19 through passageways 18, the user can embrace the pillow to keep it close to the user's torso thus providing a stable relationship between the user and the pillow. In a similar manner, the user's arms 19 while extending through passageways 18 provide the user with the ability to lean on the forearms in the resting position so as to provide added support for the shoulders and upper torso of the user.

The upper portion of compartment 12 has lateral passageway 20 open to each side and a third passageway 22 open from the backside of the pillow extending through the pillow and away from the face of the user. Passageways 20 and 22 provide the user with airflow access when the head is in place. As may best be seen in FIG. 3, the nose and mouth of the user are fully accessible to outside air through passage way 22 and although the face of the user may not be fully seen in FIG. 1, the user also has access to air through passageways 20.

Figure 2:
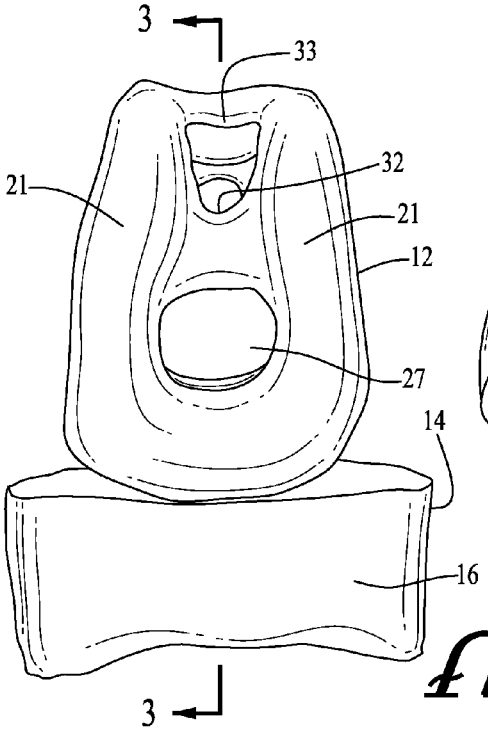
FIG. 2 is an elevation of the facing side of the inflatable pillow of the present invention.
Figure 3:
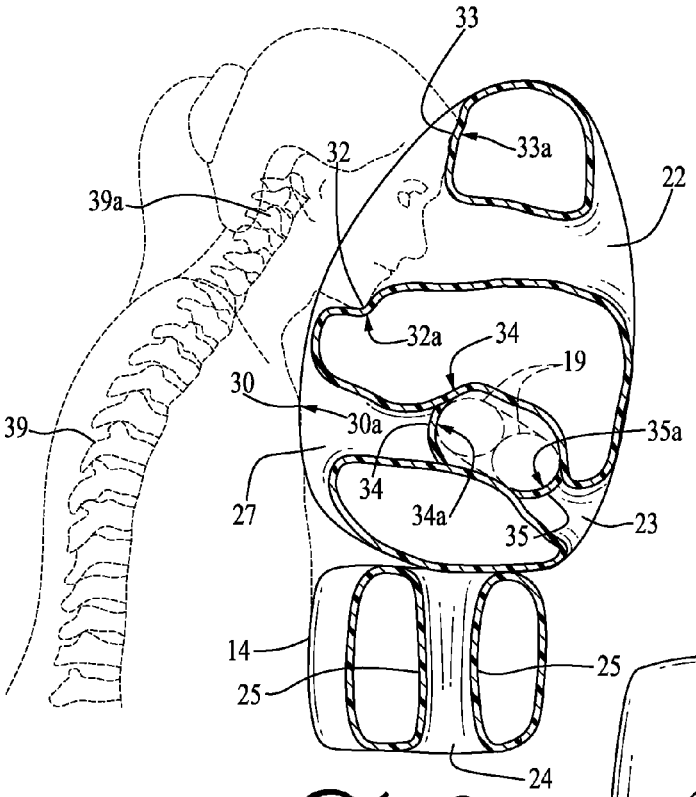
FIG. 3 is a sectional elevation view taken substantially along line 3-3 of FIG. 2, with an outline of a user shown in dotted line to illustrate the principle support points of the pillow, the interior construction features; and with the spine shown in dotted line.
Figure 4:
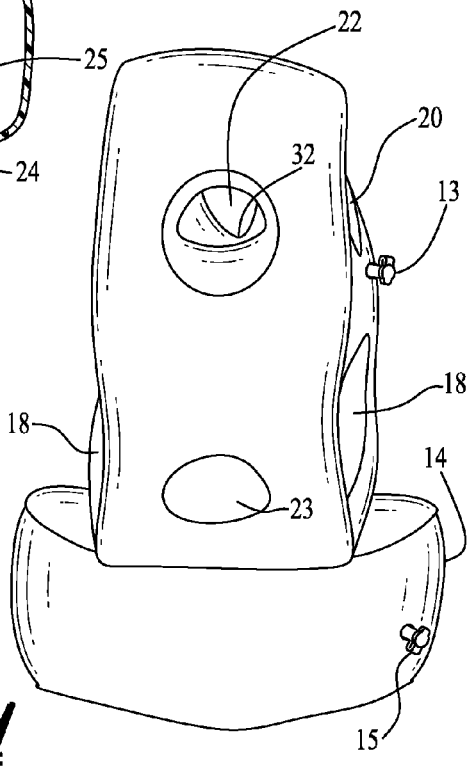
FIG. 4 is an elevation of the back side of the pillow.

Turning again to FIG. 5, it will be seen that the lower compartment 14 has a hollow center portion at 24. Hollow center 24 does not provide a passageway but rather is provided to diminish the volume of the lower compartment 14 thus requiring less air be injected, while the sidewalls 25 of hollow center 24 provide added vertical and lateral stability to support base 14. In FIGS. 2 and 3 a lower passageway 23-27 extends through from back side to face side providing reduced inside airspace and affords enhanced rigidity to the upper compartment. Opening 27 on the face side provides an indentation to accommodate a user's abdomen and/or breasts.

Turning next to FIGS. 2 and 3, the unique support features of the present invention are best illustrated. The person figure shown in dotted lines will be seen with the shoulder area at support structure 30 in contact with the upper compartment 12 gaining a pressure point 30*a*. The head and face of the user is seen in Figures land 3 in a "full-face" insertion into opening 22 in the upper area of compartment 12 which generally comprises a head receiving structure, wherein the chin of the user is conferred with chin rest structure 32 in compartment 12 conferring a pressure point 32*a*, and the forehead of the user is afforded an inner resting structure 33 in the head receiving structure obtaining a pressure point at 33*a*. Inner sidewalls 21 (see FIG. 2) of compartment 20 will contact the sides and cheeks of the user's head to provided lateral support structures for the head and neck; thus achieving the full-face plant support for the user's head.

The arms 19 of the user shown in dotted lines in FIG. 3 and in solid lines in FIG. 1 pass through passageways 18. In this posture, the forearms contact portions of passageway 20 at support structure 34 obtaining pressure points 34*a*, as the user embraces or pulls the pillow toward the torso. The forward leaning user may rest on forearms 19, contacting structure of the passageway 18 at 35, obtaining pressure points 35*a* at said structure, thereby providing through the forearms, support for the user's upper arms and shoulders. Embracing the pillow with the arms 19 enhances the stability and effectiveness of the device by engaging support structure at 30 at pressure points 30*a* against the chest and/or shoulders.

It will be seen in FIGS. 1 and 3 that the face of the user is substantially inserted into the open face of the head receiving structure and that the eyes of the user are at least partially shielded from ambient light, at least in the lateral direction. While the upper portion of passageway 22 may partly shield the user's eyes from ambient light available through passageways 20 and 22, additional light shielding could be obtained, if desired, by placing an optional flap (not shown) over the outer opening of passageway 22 or hanging inside the passageway, without substantially diminishing air ventilation to the user which would still be available through passageways 20 and 22.

Referring again to FIGS. 1 and 3, it will be seen that the user is substantially stable when in position the head receiving structure, leaning forward with the face fully planted, because the spine 39 remains substantially as straight as that obtained in an upright posture, except in the cervical area 39*a*, which is preferably caused to be tilted slightly back from the upright disposition, to hereby further relieve stress in the upper spinal area. There may be some forward curvature in the lumbar area, but to a minor degree. This is all a result of the optimum full face head support structures at 32, 33 and 21, as well as support of the upper torso at 30-30*a*, augmented by the support emanating from the forearm supports at 35*a*. This maintenance of overall body support thus achieves a substantially straight and stable optimal spinal posture providing an optimum resting position nearly as ideal as laying in a supine position with a neck support; which, by the way, fully reclining passenger seats do not achieve.

A person using the resting pillow will first inflate the upper and lower compartments through the air valves until the desired degree of inflation is obtained in each compartment. The pillow is then placed upon the user's lap and lateral passageways 18 and 20 are preferably dimensioned to adequately span the vertical space between the person's lap and head. The person using the device then leans forward as shown in FIG. 1 so that the head and neck are supported as shown in FIG. 3 with the full face of the user obtaining full support at structures 32 and 33 and 21, and the shoulders of the user obtaining support at pressure supports 30-30*a*. The full weight of the person's head thereby obtains vertical support at pressure points 32*a* and 33*a*, while the head receives lateral support by the inside wall structures 21 (see FIG. 2) which rest against the sides of the head. The full-face support of the user's head stabilizes the user's head and upper spine with the head and cervical spine tilted very slightly back, all of which diminishes the tendency of the user's head to curve at all forwardly or to allow a reverse or backward curvature of the lower spine; the overall posture hence informing an enhanced and improved beneficial posture for a resting or sleeping user. With the user's arms 19 extending through passageways 18, the user will embrace the pillow to keep it in stable contact with the body and may comfortably lean upon the forearms to obtain the benefit of supports at pressure points 35*a* to provide additional support for the upper arms and shoulders of the user.

As is clear from the foregoing description, the pillow will readily assist a person using it to comfortably rest or sleep while sitting in an upright, forward leaning position. When it is desired to terminate use and store the resting pillow, air valves 13 and 15 may be opened to exhaust the air so that the pillow may be folded up and stored in a compact condition.

While a preferred embodiment of the present invention has been shown and described in some detail, it will be obvious to those skilled in the art to employ alterations or variations of the design without departing from the inventive concepts; hence, it is not intended that the invention be limited to the single embodiment or features thereof as shown and described above, rather that the invention enjoy the full scope of the invention as set forth in the accompanying claims.

What is claimed is:

1. A resting device to facilitate a user comfortably reposing while in a forward leaning sitting position, comprising:

an inflatable structure comprising two attached compartments, a lower compartment and an upper compartment, each said compartment composed of flexible air-retentive materials, each compartment having valve means for selectively inflating each said compartment;

said lower compartment configured to provide a support base for said resting device;

said upper compartment being configured on one side thereof to provide a head receiving structure, said head receiving structure having a peripheral structure configured to accommodate the head of a user with portions configured to contact the chin, the forehead and sides of the head to facilitate stable head support, said upper compartment being further configured to receive contact of the upper torso and shoulder areas of the user;

said upper compartment further having a plurality of passageways formed therein, a first one of said passageways configured to facilitate air flow to the location of said head receiving structure, a second of said passageways configured to accommodate one or more portions of a user's upper body;

said second of said passageways further including a lateral passageway, said lateral passageway having interior walls which receive contact of the forearms of the user to thereby provide support for one or more portions of said person's upper torso.

2. The resting device as defined in claim 1, wherein:

said second of said passageways extends laterally through the entirety of said upper compartment, said lateral passageway having a plurality of interior walls which receive contact of the forearms of the user.

3. The resting device as defined in claim 2, wherein:

the said interior walls of said lateral passageway include a lower wall for receiving the forearms of the user, said lower wall defining an area to support the user's upper torso and shoulders when the user is in a forward leaning sitting position.

4. The resting device as defined in claim 3, wherein:

the said lateral passageway walls further include side walls to accommodate the user's forearms to further facilitate stabilization of the said resting device against the user's torso.

5. The resting device as defined in claim 3, wherein:

the interior side walls in said lateral passageways further provide a plurality of pressure points for stabilizing the said resting device and the user's body by providing means for embracing the device against the user's lower torso and an exterior of said lower compartment.

6. The resting device as defined in claim 2, wherein:

the configuration of the passageways in the head receiving structure that include the structures which receive the user's chin and forehead and that provide lateral support further include means to obscure ambient light from the user's face and eyes.

7. The resting device as defined in claim 1, wherein:

a portion of said base is configured in part to accommodate the physical shape of a portion of said user's lower torso.

8. A resting device to facilitate a user comfortably reposing while in a forward leaning sitting position, comprising:

an inflatable structure comprising two attached compartments, a lower compartment and an upper compartment, each compartment composed of flexible air-retentive materials, each compartment having means for selectively inflating each said compartment;

said lower compartment furnishing a support base for said resting device;

said upper compartment being configured on one side thereof to provide a head receiving structure, said head receiving structure configured to accommodate a full-face insertion thereinto, a plurality of pressure point surfaces in said head receiving structure positioned to surround the periphery of the user's head, the orientation of said head receiving structure with respect to the orientation of the upper compartment and the arrangement of the peripheral pressure surfaces located therein configured to position the user's head so as to retain the user's cervical vertebrae in a posture that optimally reduces stress in the cervical vertebrae when the user is comfortably reposing in a forward leaning sitting position;

and said upper compartment further having a plurality of passageways formed therein.

9. The resting device as defined in claim 8, wherein:

at least one of said passageways extends laterally through the entirety of said upper compartment, said lateral passageway having a plurality of interior walls which receive contact of the forearms of said user;

said interior walls of said lateral passageway including a lower wall for receiving the forearms of the user, said lower wall defining an area to support the user's upper torso and shoulders when the user is leaning forward in a sitting position resting the forearms upon the aforesaid lower walls of said lateral passageway.

10. The resting device as defined in claim 9, wherein:

one or more of the plurality of pressure surfaces in the head receiving structure and the orientation of the head receiving structure are positioned to receive the person's chin and forehead to enhance support for the person's head, neck and spine wherein the head receiving structure is provided with laterally opposed pressure means to affect lateral support of the person's head, neck and spine in the optimal, at rest configuration of the cervical vertebrae.

* * * * *